United States Patent [19]

Waddington et al.

[11] 4,148,136

[45] Apr. 10, 1979

[54] METHOD OF MAKING A TUBULAR ELECTRICAL CONNECTOR, BLANK AND METHOD FOR MAKING

[75] Inventors: William T. Waddington, Fanwood; Harold F. Jenkins, Irvington; Paul T. Filak, Roselle Park, all of N.J.

[73] Assignee: Amerace Corporation, New York, N.Y.

[21] Appl. No.: 798,899

[22] Filed: May 20, 1977

Related U.S. Application Data

[62] Division of Ser. No. 677,406, Apr. 15, 1976, Pat. No. 4,040,711.

[51] Int. Cl.[2] ..... H01R 43/00

[52] U.S. Cl. ..... 29/629; 29/510; 29/630 A; 113/119

[58] Field of Search ..... 29/629, 630 A, 510; 113/119; 339/198 R, 198 G, 198 GA, 198 N, 198 H, 272 R, 272 A, 248 R

[56] References Cited

U.S. PATENT DOCUMENTS

| | | | |
|---|---|---|---|
| 1,266,441 | 5/1918 | Finkelstein | 339/248 R |
| 1,352,034 | 9/1920 | Sherman | 29/629 |
| 3,245,029 | 4/1966 | Piperato | 339/198 GA |
| 3,296,576 | 1/1967 | Motten, Jr. | 339/272 R |

FOREIGN PATENT DOCUMENTS

| | | | |
|---|---|---|---|
| 781246 | 8/1957 | United Kingdom | 339/198 N |

*Primary Examiner*—Carl E. Hall

*Attorney, Agent, or Firm*—S. Michael Bender; Ken Richardson

[57] ABSTRACT

A tubular electrical connector having first and second tubular contact members spaced from one another to establish a gap between them and joined in a unitary structure by a strap unitary with corresponding wall portions of the tubular contact members and bridging the gap, a contact bar bridging the gap and secured in each tubular contact member, and a clamping screw for securing a conductor in each tubular contact member against the contact bar. The gap receives a complementary projection on a terminal block to locate and secure the connector in a terminal block assembly. The connector is fabricated by providing and then bending a metal blank along prescribed boundaries, welding along confronting edges, subsequent to bending, and then locating and securing the contact bar in place.

6 Claims, 6 Drawing Figures

METHOD OF MAKING A TUBULAR ELECTRICAL CONNECTOR, BLANK AND METHOD FOR MAKING

This is a division of application Ser. No. 677,406, filed Apr. 15, 1976 now U.S. Pat. No. 4,040,711.

The present invention relates generally to electrical connectors and pertains, more specifically, to tubular electrical connectors of the type which are assembled with terminal blocks of dielectric material to construct terminal block assemblies.

Tubular electrical connectors of the type which are employed in terminal block assemblies usually are fabricated of copper which has been drawn from seamless, round tubing into a rectangular shape. Further operations include cutting to length, and then drilling and tapping holes for clamping screws, as well as further finishing steps such as deburring and plating. A characteristic of many such connectors is that they have an excess of conductive capacity due to the large cross-section of the connector, which generally exceeds that of the largest wire conductor accepted by the connector. Since copper is becoming more difficult to obtain and, hence, is increasing in price, conventional tubular electrical connectors exhibit a drawback in their requirement for an excessive amount of copper. Another shortcoming of such conventional connectors is that the strength of the threads in the conductor clamping arrangement is limited by the relatively low shear strength of the copper in which the clamping screws are threaded. Thus, only limited torque can be applied to the clamping screws in securing conductors in the connector.

It is an object of the present invention to provide a tubular electrical connector for use in terminal block assemblies which reduces the requirement for copper, or a similar highly conductive metal, while providing a connector of adequate strength to withstand the clamping forces necessary to secure conductors in the connector.

Another object of the invention is to provide a tubular electrical connector having tubular contact members fabricated of sheet metal, such as steel, with a contact bar of a more highly conductive metal, such as copper, secured within the tubular contact members for engagement by the conductors secured in the tubular contact members.

Still another object of the invention is to provide a tubular electrical connector which is readily and economically fabricated of a relatively plentiful material, such as sheet steel, and augmented with an appropriate amount of copper, or a similar conductive material, for superior conductivity, the connector having a configuration enabling ease of assembly with a terminal block and effective performance in such an assembly.

A further object of the invention is to provide a sheet metal blank having a configuration appropriate for the economical fabrication of the aforesaid tubular electrical connector.

A still further object of the invention is to provide a method whereby tubular electrical connectors of the type described above are economically manufactured in large numbers of uniform high quality.

The above objects, as well as still further objects and advantages, are attained by the present invention, which may be described briefly as an electrical connector for connecting the terminal ends of electrical conductors in a terminal block assembly, the electrical connector comprising first and second tubular contact members, each contact member having a bottom wall extending longitudinally between opposite ends, a top wall and opposite side walls, the confronting ends of the bottom walls of the first and second tubular contact members and at least first ones of the top and side walls being spaced apart longitudinally such that a gap exists between the first and second tubular contact members, a strap unitary with corresponding second ones of the top and side walls and bridging the gap between the first and second tubular contact members, a contact bar extending into each tubular contact member, juxtaposed with the bottom walls thereof, and bridging the gap, and a clamping member mounted in the top wall of each tubular contact member for clamping a conductor against the contact bar within each tubular contact member.

The invention will be more fully understood, while still further objects and advantages thereof will become apparent, by reference to the following detailed description of an embodiment of the invention illustrated in the accompanying drawing, in which.

Figure 1:
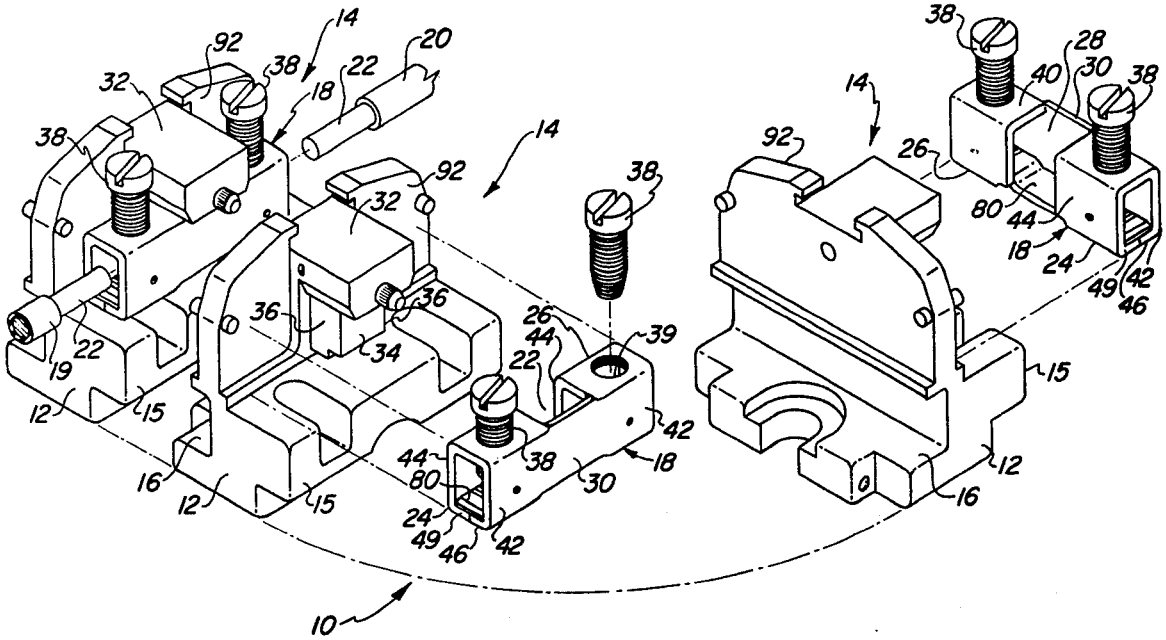
FIG. 1 is an exploded perspective view of a terminal block assembly utilizing tubular electrical connectors constructed in accordance with the invention.

Referring now to the drawing, and especially to FIG. 1 thereof, a terminal block assembly is illustrated in an exploded perspective view generally at 10 and is seen to be a modular construction in which any number of individual terminal blocks 12 may be joined together to form a strip of terminal blocks of any desired number of terminal sections 14 by engaging a ledge 15 of a terminal block 12 of one section 14 with a complementary channel 16 in a terminal block of an adjacent section 14 in a now well-known manner. Each terminal section 14 includes one terminal block 12 of dielectric material and one tubular electrical connector 18 for connecting one electrical wire 19 to another electrical wire 20, each electrical wire 19 and 20 having a conductor 22 which is to be received and secured within tubular electrical connector 18.

Tubular electrical connector 18 is constructed in accordance with the invention and is seen to include a first tubular contact member 24 and a second tubular contact member 26 spaced longitudinally from one another so as to establish a gap 28 between tubular contact members 24 and 26. A strap 30 is unitary with the tubular contact members 24 and 26 and bridges the gap 28 such that the tubular contact members 24 and 26 and the strap 30 constitute a single, unitary structure.

Each terminal block 12 carries a projection 32 which includes a depending abutment portion 34. Upon assembly of a tubular electrical connector 18 with a terminal block 12, the tubular electrical connector is secured in place by projection 32 which passes over the connector 18 to capture and hold the connector 18 in place. Abutment portion 34 of projection 32 extends into gap 28 of connector 18 thereby locating and fixing the connector 18 longitudinally relative to terminal block 12. Abutment portion 34 also provides a locating stop face 36 for each conductor 22 so that the conductor 22 can be inserted into a tubular contact member only up to a prescribed length. Thus, gap 28 provides means by which the connector 18 is properly assembled with a corresponding terminal block 12. Upon proper location of each conductor 22 within a tubular contact member 24 or 26, the conductor is secured in place by a clamping member shown in the form of a clamping screw 38 received within a complementary threaded aperture 39.

Aperture 39 extends through a top wall 40 of each tubular contact member 24 and 26, the tubular contact members having opposite side walls 42 and 44 and a bottom wall 46, as well as top wall 40. Each bottom wall 46 extends longitudinally between opposite ends 48 and 49, and confronting ends 48 are spaced apart longitudinally (also see FIG. 5) for purposes which will be more fully set forth below. Side walls 42 and 44 are perpendicular to top wall 40 and bottom wall 46 so that each tubular contact member has a rectangular cross-sectional configuration.

Figure 2:
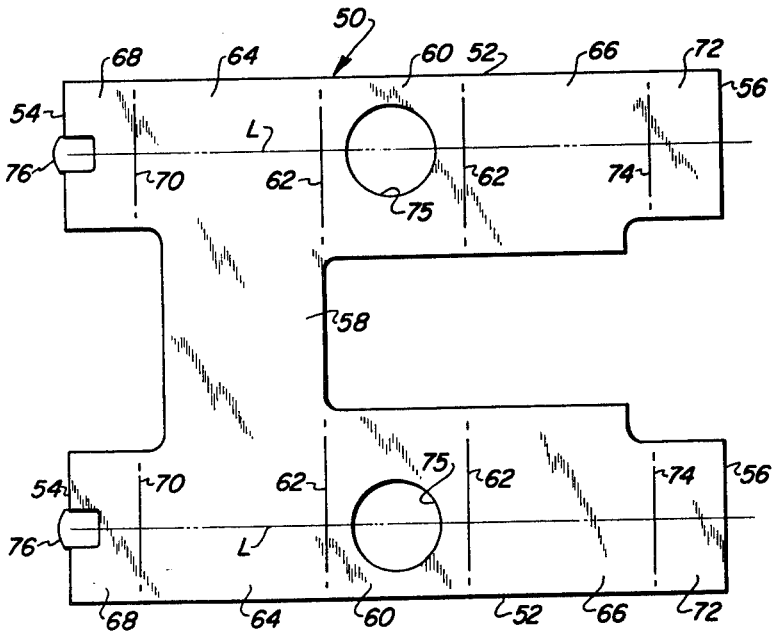
FIG. 2 is a top plan view of a blank employed to construct the tubular electrical connector.

Tubular electrical connector 18 is economically fabricated from sheet metal, the metal preferably being sheet steel. Turning now to FIG. 2, a blank employed in the construction of connector 18 is shown at 50 and is seen to comprise a flat sheet of metal having a pair of elements 52 each extending in a given direction, parallel to one another, between opposite edges 54 and 56. Elements 52 are spaced apart transversely and a web 58 interconnects the elements 52 intermediate the edges 54 and 56.

Elements 52 are divided into several portions extending between boundaries which extend in the transverse direction across the elements 52. Thus, top wall portions 60 lie between opposite boundaries 62, a first side wall portion 64 is contiguous with top wall portion 60 along one boundary 62, while a second side wall portion 66 is contiguous with top wall portion 60 along the other boundary 62. A first bottom wall portion 68 is contiguous with first side wall portion 64 along a boundary 70, while a second bottom wall portion 72 is contiguous with second side wall portion 66 along a boundary 74. Web 58 constitutes a strap portion unitary with first side wall portions 64.

Blank 50 is easily fabricated by punching from sheet stock material. Holes 75, corresponding to the location of threaded apertures 39, are also punched through top wall portions 60. A pair of protuberances 76 are located one at each edge 54, the protuberances being permanently deformed from the material of the blank 50 as by coining so as to project outwardly from edges 54. Each protuberance 76 is aligned with a hole 75 in the direction of extent of the corresponding element 50, i.e., along line L, for purposes which will be described below.

Figure 3:
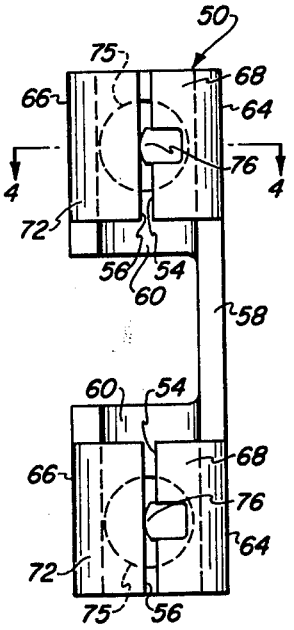
FIG. 3 is a bottom plan view of a part of the tubular electrical connector during a stage of fabrication.
Figure 4:
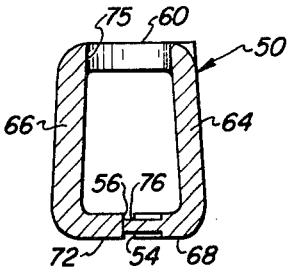
FIG. 4 is a cross-sectional view taken along line 4—4 of FIG. 3.
Figure 5:
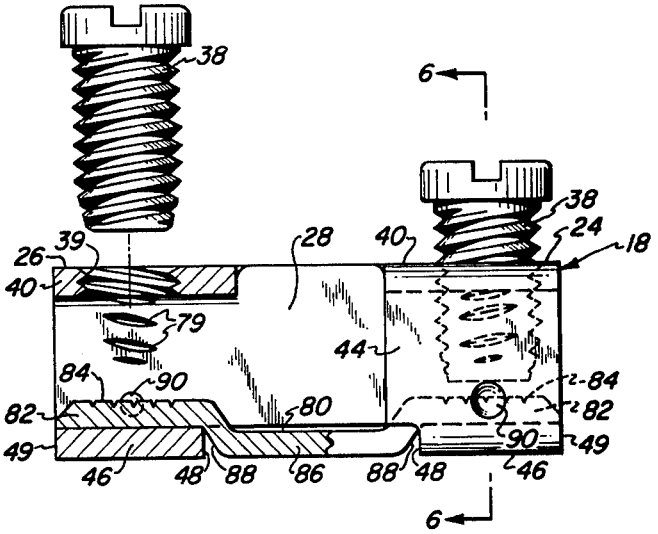
FIG. 5 is a partially sectioned, partially exploded elevational view of the completed tubular electrical connector.
Figure 6:
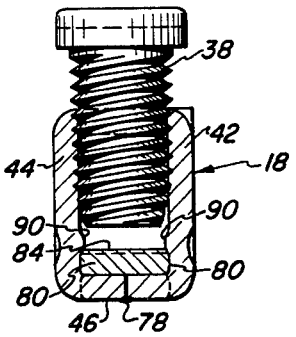
FIG. 6 is a cross-sectional view taken along line 6—6 of FIG. 5.

As best seen in FIGS. 3 and 4, the method of making electrical connector 18 in accordance with the invention includes constructing the first and second tubular contact members 24 and 26 by bending the several portions of the blank 50 at the boundaries thereof into a configuration where each side wall portion 64 and 66 is generally perpendicular to the top wall portion 60 and to each bottom wall portion 68 and 72, in both elements 52. Edges 54 and 56 then confront one another, with protuberances 76 projecting from edges 54 and engaging confronting edges 56. Each bottom wall portion 68 is then welded to confronting bottom wall portion 72 at the locations of the protuberances 76 to establish the closed tubular contact members 24 and 26 having a rectangular cross-sectional configuration (as best seen in FIG. 6). Preferably, electrical resistance welding is employed and the protuberances 76 serve to place the weld 78 where maximum mechanical strength is required, i.e., directly beneath the clamping screw 38. The alignment of each protuberance 76 with a corresponding hole 75, along a line L, assures that the protuberance 76 will be placed beneath hole 75, as seen in FIG. 3, so that the weld 78 ultimately will be placed beneath clamping screw 38, as seen in FIG. 6. Subsequently, holes 75 are threaded by tapping, the tapping operation also serving to place thread portion 79 (see FIGS. 5 and 6) in the side walls 42 and 44 for added clamping strength.

While the above-described sheet steel blank and method provide an economical means for fabricating the desired configuration of tubular contact members 24 and 26, and enable the tubular contact members to exhibit relatively great structural strength and high clamping forces for capturing conductors therein, the particular material which provides ease of manufacture and high strength does not exhibit the degree of electrical conductivity desired in a device of the nature described. Thus, as best seen in FIGS. 5 and 6, as well as in FIG. 1, electrical connector 18 is provided with a contact bar 80 of a material having a high electrical conductivity, such as copper.

Contact bar 80 includes opposite end portions 82 each having a serrated upper clamping surface 84, clamping surfaces 84 being in general alignment with one another in the longitudinal direction. An intermediate portion 86 of contact bar 80 lies outside the alignment of clamping surfaces 84, thereby establishing lateral shoulders 88. Contact bar 80 is inserted and placed within the tubular contact members 24 and 26, as seen in FIGS. 5 and 6, such that the end portions 82 are juxtaposed with the bottom walls 46 and intermediate portion 86 bridges the gap 28 in the space between confronting ends 48 of the bottom walls 46. Such location of contact bar 80 places shoulders 88 at confronting ends 48 so that the abutment of shoulders 88 with ends 48 of bottom walls 46 precludes longitudinal movement of contact bar 80 relative to the tubular contact members 24 and 26. Portions of the side walls are then deformed permanently to provide permanent deformations 90 placed in the opposite side walls 42 and 44 so as to secure the contact bar 80 in place.

Once construction of the electrical connector 18 is complete, with contact bar 80 secured in place within tubular contact members 24 and 26 and with clamping screws 38 in place within threaded apertures 39, electrical connector 18 is assembled with a terminal block 12, as seen in FIG. 1. The unitary construction of the two tubular contact members 24 and 26, joined together by strap 30 which is unitary with the members 24 and 26, not only enables ease of manufacture of the electrical connector 18 with ready control of critical dimensional relationships between the tubular contact members 24 and 26, as well as within each tubular contact member itself, but also facilitates handling of the tubular contact members during assembly of the electrical connector 18 with a terminal block 12, while providing a construction of relatively high strength. Thus, electrical connector 18 is merely located upon ledge 15 of a terminal block 12 and moved laterally toward wall 92 of the terminal block and beneath projection 32. Depending abutment portion 34 of the projection 32 will enter gap 28, while intermediate portion 86 of contact bar 80 will slip beneath depending abutment portion 34. The electrical connector 18 thus is held securely in place within the terminal block 12. Upon placement of the next adjacent terminal block 12 into the terminal block assembly 10, the electrical connector 18 will be securely locked in place.

It is to be understood that the above detailed description of an embodiment of the invention is provided by way of example only. Various details of design and construction may be modified without departing from the true spirit and scope of the invention set forth in the appended claims.

We claim:

1. A method of making an electrical connector having first and second tubular contact members, each with a bottom wall extending longitudinally between opposite ends, a top wall and opposite side walls, the tubular contact members being spaced apart longitudinally to establish a gap therebetween and joined in a unitary structure through a strap bridging the gap, the strap being unitary with corresponding ones of said top and side walls, and a contact bar bridging the gap and extending into each tubular contact, said method comprising the steps of:

providing a flat sheet of metal having a pair of elements extending in a given direction between opposite edges, parallel to one another and spaced in a transverse direction from one another, each element including a top wall portion having opposite boundaries extending in said transverse direction and spaced from one another in said given direction;

first and second side wall portions contiguous with the top wall portion along said opposite boundaries of the top wall portion;

at least one bottom wall portion contiguous with a side wall portion along a transversely extending boundary opposite to the adjacent boundary between that side wall portion and the top wall portion; and a strap portion extending transverse to said pair of elements and unitary therewith, said strap portion joining corresponding ones of said top wall portions and said side wall portions said pair of elements being transversely spaced along an entire extent thereof except where joined by said strap portion;

bending each element along said boundaries to bring the opposite edges into confrontation with one another;

welding at least portions of the confronting edges to one another to establish said first and second tubular contact members; said first and second contact members being joined only by said strap portion; and Inserting the contact bar into the tubular contact members.

2. The invention of claim 1 wherein each element is bent along said boundaries until the side wall portions are generally perpendicular to the top wall portions and to the bottom wall portions.

3. A method of making an electrical connector having first and second tubular contact members, each with a bottom wall extending longitudinally between opposite ends, a top wall and opposite side walls, the tubular contact members being spaced apart longitudinally to establish a gap therebetween and joined in a unitary structure through a strap bridging the gap, the strap being unitary with corresponding ones of said top and side walls, and a contact bar bridging the gap and extending into each tubular contact, said method comprising the steps of:

providing a flat sheet of metal having a pair of elements extending in a given direction between opposite edges, parallel to one another and spaced in a transverse direction from one another, each element including a top wall portion having opposite boundaries extending in said transverse direction and spaced from one another in said given direction;

first and second side wall portions contiguous with the top wall portion along said opposite boundaries of the top wall portion;

at least one bottom wall portion contiguous with a side wall portion along a transversely extending boundary opposite to the adjacent boundary between that side wall portion and the top wall portion; and a strap portion extending transverse to said pair of elements and unitary therewith, said strap portion joining corresponding ones of said top wall portions and said side wall portions;

bending each element along said boundaries to bring the opposite edges into confrontation with one another;

welding at least portions of the confronting edges to one another to establish the tubular contact members; and inserting the contact bar into the tubular contact members, wherein each element is bent along said boundaries until the side wall portions are generally perpendicular to the top wall portions and to the bottom wall portions, and wherein the contact bar includes aligned opposite end portions and an intermediate portion lying outside said alignment, said step of inserting the contact bar including:

locating the intermediate portion within the gap and in the space between the bottom walls of the spaced tubular contact members;

said method including the further step of permanently deforming portions of the side walls inwardly at the opposite end portions of the contact bar to secure the opposite end portions against the bottom walls of the tubular contact members.

4. The invention of claim 3 including providing a protuberance projecting in said given direction from the edge of each element such that said welding takes place where the protuberance engages the confronting edge of the element after bending.

5. The invention of claim 3 including providing an aperture in each top wall portion.

6. The invention of claim 5 wherein the protuberance is located beneath the aperture after bending such that said welding takes place beneath the aperture.

* * * * *